United States Patent [19]

Amundsen

[11] 4,214,342

[45] Jul. 29, 1980

[54] GRILL CLEANING TOOL

[76] Inventor: Paul D. Amundsen, 704 S.W. 119th, Seattle, Wash. 98146

[21] Appl. No.: 917,870

[22] Filed: Jun. 22, 1978

[51] Int. Cl.[3] ..... A47L 17/00

[52] U.S. Cl. ..... 15/236 R; 15/105; 30/169

[58] Field of Search ..... 15/105, 236 R, 104.04; 30/92.5, 113.1, 121.5, 123.5, 169, 171, 316, 352; 81/3 R, 9.5 C; 145/46; 254/25

[56] References Cited

U.S. PATENT DOCUMENTS

| | | | |
|---|---|---|---|
| D. 242,687 | 12/1976 | Broberg, Jr. | D7/184 |
| 481,528 | 8/1892 | Gates | 30/352 X |
| 598,306 | 2/1898 | Henderson | 254/25 |
| 698,567 | 4/1902 | Sibley | 81/9.5 C |
| 758,017 | 4/1904 | Parish | 254/25 |
| 929,171 | 7/1909 | Skabroud | 30/352 X |
| 1,235,038 | 7/1917 | Klinka . | |
| 1,454,239 | 5/1923 | Kawamura | 254/25 |
| 1,759,539 | 5/1930 | Carlson | 30/316 X |
| 2,294,096 | 8/1942 | Rice | 30/165 |
| 2,297,566 | 9/1942 | Laux | 15/236 R UX |
| 2,361,402 | 10/1944 | Jamieson | 30/171 X |
| 2,649,604 | 8/1953 | Hess | 15/236 |
| 2,745,129 | 5/1956 | Johnson | 15/236 |
| 2,824,333 | 2/1958 | Tos et al. | 15/105 |
| 3,250,308 | 5/1966 | March | 145/46 |
| 3,310,826 | 3/1967 | Ellis | 15/105 |
| 3,487,491 | 1/1970 | Dunn | 15/111 |
| 3,820,185 | 6/1974 | Phillips | 15/236 R |
| 3,987,827 | 10/1976 | Mills | 254/25 X |

*Primary Examiner*—Philip R. Coe

*Attorney, Agent, or Firm*—David H. Deits; Roy E. Mattern, Jr.; Kenneth S. Kessler

[57] ABSTRACT

A grill cleaning tool is provided having a tubular body which forms a handle. A projection from one end of the handle is formed integrally with the handle from a length of steel tubing. The end of the projection is beveled to form a sharp angle. A groove is provided in the extreme end of the projection for closely engaging a grill rod to scrape deposits from the rod's surface. The sharp bevel permits the tool to scrape deposits from the surfaces of closely spaced grill rods. A similar projection extends from the opposite side of the handle for cleaning differently sized grill rods.

6 Claims, 6 Drawing Figures

GRILL CLEANING TOOL

BACKGROUND OF THE INVENTION

1. Field of the Invention

The invention is a grill cleaning tool of the type provided to scrape food and other deposits from the surface of rods of the type which form a grill surface for cooking food as in barbecues.

2. Prior Art

Grill cleaning tools performing a function similar to the invention are illustrated in the following United States patents: U.S. Pat. Nos. 3,820,185, C. D. Phillips; Des. 242,687, D. O. Broberg, Jr.; and 3,310,826, R. M. Ellis.

SUMMARY OF THE INVENTION

A grill cleaning tool is provided for use in removing food and other deposits from the surface of grill rods. A preferred form consists of a tubular cylinder which forms a handle with an integral projection with a sharply beveled end. The extreme end of the projection has a centrally located groove for closely receiving a grill rod. The edges of the groove are beveled to form a thin edge. Preferably there is a similarly beveled projection on the opposite end of the tool also having a groove for closely receiving a grill rod. This groove is larger than that on the opposite end. The beveling is preferably less sharp, in the area of 35 degrees as compared to 10 degrees or less for the other end.

DETAILED DESCRIPTION OF THE INVENTION

Figure 1:
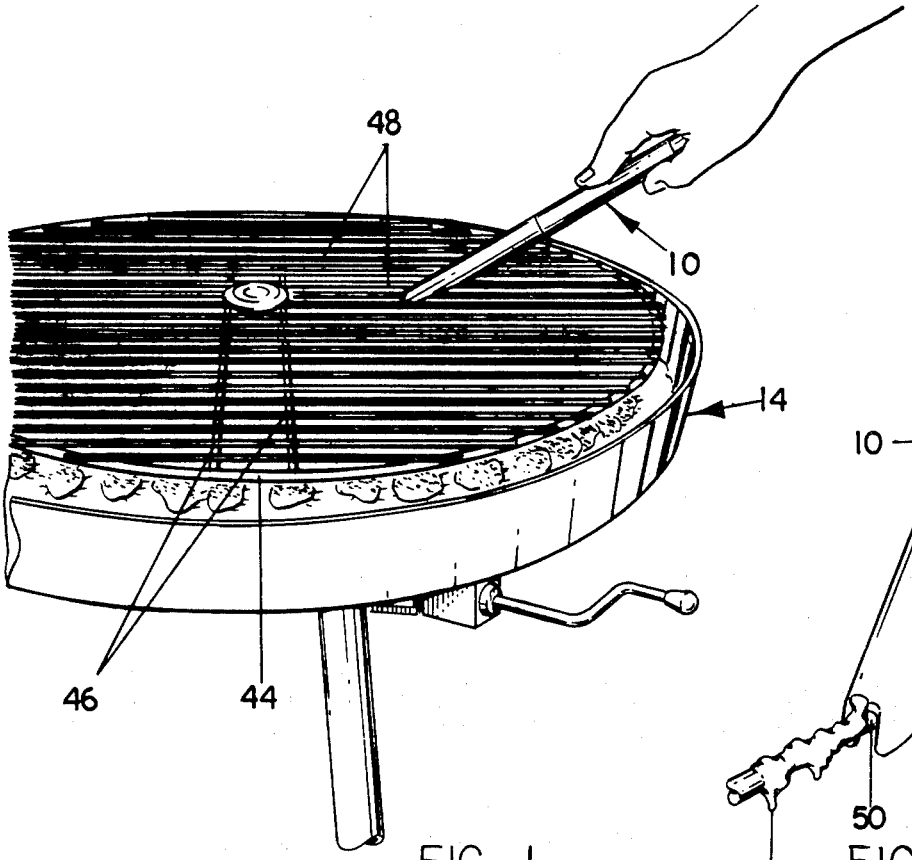
FIG. 1 is a perspective view of the grill cleaning tool in use on a barbecue grill.
Figure 2:
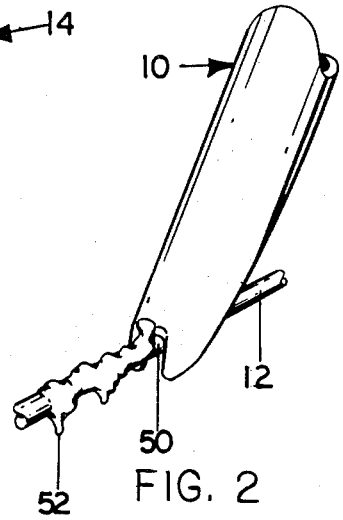
FIG. 2 is an enlarged detail of one end of the tool illustrating its use in removing deposits from the surface of a grill rod.
Figure 3:
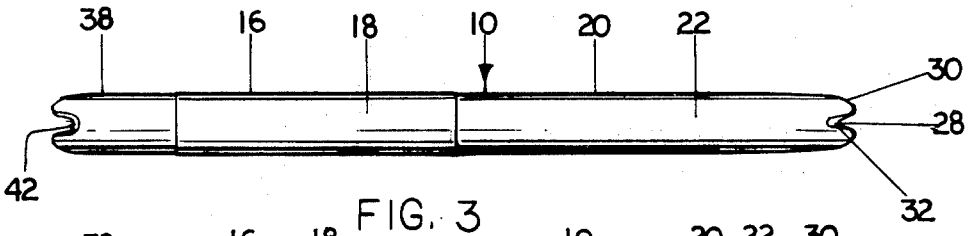
FIG. 3 is a top plan view of the tool.
Figure 4:
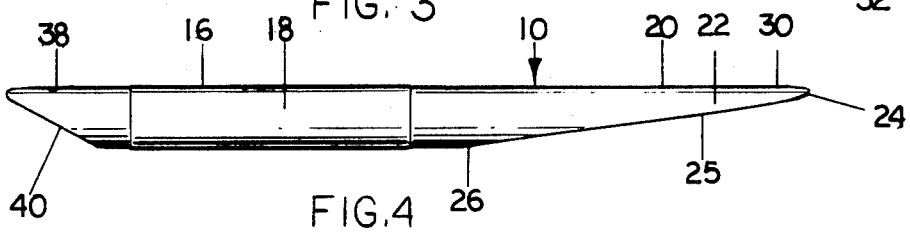
FIG. 4 is a side elevation view of the tool.
Figure 6:
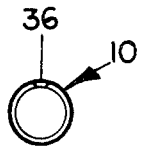
FIG. 6 is an end elevation view of the right end of the tool as seen in FIG. 4.
Figure 5:
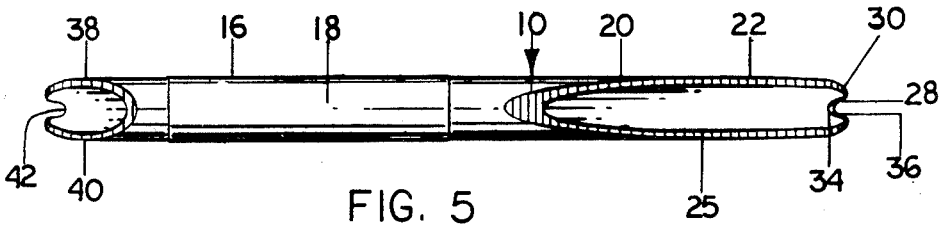
FIG. 5 is a bottom plan view of the tool.

A grill cleaning tool 10 is provided for use in removing food and other deposits from the surface of grill rods 12 such as those on a barbecue 14 as illustrated in FIGS. 1 and 2. The preferred embodiment is illustrated in the drawing FIGS. 1—6. The tool consists of a body 16, preferably a tubular cylinder, which forms a handle for the tool. The handle may be provided with a gripping surface 18 in the form of a plastic sleeve, painted surface or the like. A projection 20 extends from one end of the handle with a curved wall surface 22. In its preferred form, as shown, the projection has a cylindrical exterior surface 22 and is formed along with the handle from a single piece of rigid tubing, such as ⅝ inch or ½" diameter stainless steel tubing. This provides a very rigid, yet economical form of construction. The projection is beveled as shown most clearly in FIG. 4 so that one side 24 of its end surface 25 projects further than the diametrically opposite side 26 of the projection. A groove 28 is provided in the end of the projection for closely receiving a grill rod. Preferably the groove is centrally located, as shown in FIG. 3 in the outermost end 30 of the projection. Preferably, the edges of the projection wall around the groove are beveled as at 32 and 34 on one or both sides to form a thin edge 36. Preferably there is a second projection 38 on the opposite end of the handle of a similar construction, having a beveled end 40 and a groove 42 centrally located in its extreme end for, likewise, closely receiving a grill rod. Preferably the first end 20 is beveled sharply forming an angle of less than 10 degrees or so. The opposite end 38 is less sharply beveled, for example, at an angle of about 35 degrees. The groove 42 on the less sharply tapered end is preferably larger than the other groove 36 to permit the reception of larger grill rods such as the bordering grill member 44 and support rods 46 which are typically heavier than the top surface rods 48. The sharply beveled end which is used for cleaning the top surface rods can, because of the tubular structure of the tool and the beveled end, be lowered to a low angle with respect to a grill rod to permit cleaning of the bottom of a grill rod from the top. This is done by engaging the rod to be cleaned in the groove 28 in the manner shown in FIG. 2 but with the tool held more closely to the plane of the grill. The rod can thus be cleaned along one side then the other with the groove closely engaging the surface 50 of the grill rod 12 in order to scrape off food deposits 52. In this manner the grill does not have to be removed from the barbecue pit to be cleaned.

The tool, rather than being made from a single piece of tubing may be stamped from a flat piece of sheet metal and rolled into the tubular shape. The abutting edges of the rolled sheet may, but need not, be secured together such as by welding.

I claim:

1. A grill cleaning tool for removing deposits from the surface of grill rods comprising:

(a) a body which forms a handle for the tool having a first end; and (b) a straight projection of rigid material extending from the first end of the handle, the projection having a wall having a curved transverse cross-section and an end portion opposite the handle, defining a closed end groove for closely receiving a grill rod, and wherein the projection is beveled so that the wall has opposite edges which extend angularly from the end of the projection on either side of the groove beyond the closed end of the groove toward the handle to permit the tool to engage the grill rod at a low relative angle.

2. A grill cleaning tool for removing deposits from the surface of grill rods, as claimed in claim 1, wherein the projection wall has a transverse cross-section with the curvature being uniform throughout the length of the projection.

3. A grill cleaning tool for removing deposits from the surface of grill rods, as claimed in claim 1, wherein the groove is centrally located in the end of the projection.

4. A grill cleaning tool for removing deposits from the surface of grill rods, as claimed in claim 1, wherein the handle has a curved wall surface which is co-planar with the projection.

5. A grill cleaning tool for removing deposits from the surface of grill rods, as claimed in claim 4, wherein the handle is tubular.

6. A grill cleaning tool for removing deposits from the surface of grill rods, as claimed in claim 5 wherein the handle comprises a cylindrical tube.

* * * * *